US012325500B2

(12) United States Patent
Harshberger

(10) Patent No.: US 12,325,500 B2
(45) Date of Patent: Jun. 10, 2025

(54) ALTERNATING CURRENT BOAT PROPULSION SYSTEM

(71) Applicant: David Harshberger, Nappanee, IN (US)

(72) Inventor: David Harshberger, Nappanee, IN (US)

( * ) Notice: Subject to any disclaimer, the term of this patent is extended or adjusted under 35 U.S.C. 154(b) by 470 days.

(21) Appl. No.: 17/804,207

(22) Filed: May 26, 2022

(65) Prior Publication Data

US 2023/0382508 A1 Nov. 30, 2023

(51) Int. Cl.
*B63H 20/00* (2006.01)
*B63H 21/17* (2006.01)

(52) U.S. Cl.
CPC ..... *B63H 20/007* (2013.01); *B63H 21/17* (2013.01)

(58) Field of Classification Search
CPC ..... B63H 20/007; B63H 21/21
See application file for complete search history.

(56) References Cited

U.S. PATENT DOCUMENTS

| | | | | |
|---|---|---|---|---|
| 3,895,276 A | | 7/1975 | Brown et al. | |
| 5,816,870 A | * | 10/1998 | Rubin | B63H 23/34 440/6 |
| 6,054,831 A | * | 4/2000 | Moore | G08C 17/02 318/16 |
| 6,616,489 B1 | * | 9/2003 | Dompierre | B63H 20/00 440/49 |
| 2012/0204467 A1 | * | 8/2012 | Palmer | A01K 79/02 43/4.5 |

OTHER PUBLICATIONS

Franklin 4-inch Super Stainless Water Well Motor, 2 hp, 230 VAC, 3 phase—website printout (2 pages) https://www.franklinwater.com/products/submersible-motors-and-control-boxes/4-inch-submersible-motors/4-inch-induction-motor/4-inch-three-phase-models--sku-collection/2343159204gs/, Jan. 2025.

Harbor Freight Predator 3500 Watt Inverter Generator—website printout (4 pages) https://www.harborfreight.com/3500-watt-super-quiet-inverter-generator-with-co-secure-technology-epa-71358.html, Jan. 2025.

KB Electronics VFD model No. KBDF-27D brochure (4 pages), Feb. 2012.

* cited by examiner

*Primary Examiner* — Stephen P Avila
(74) *Attorney, Agent, or Firm* — Thomas J. Oppold; Larkin Hoffman Daly & Lindgren, Ltd.

(57) ABSTRACT

An alternating current (AC) propulsion system for a boat. The AC propulsion system includes a trolling motor operably mountable to the boat and an AC power system. The trolling motor has a head and a motor housing secured at upper and lower ends, respectively, to an elongated shaft. An AC motor is disposed in the motor housing and drives a propeller. The AC power system includes a generator and a variable frequency drive (VFD). The VFD includes a VFD AC input and a VFD AC output. The VFD AC input is electrically coupled to an AC output of the generator. The VFD AC output is operably electrically coupled to the AC motor of the trolling motor. In some embodiments a second trolling motor with an AC motor may be electrically coupled to a second VFD AC output of the VFD.

20 Claims, 10 Drawing Sheets

ALTERNATING CURRENT BOAT PROPULSION SYSTEM

BACKGROUND

Most anglers use a gas powered outboard motor as the primary means of propelling the boat when cruising on plane to the desired destination on a body of water. Once the angler reaches a desired destination, the angler lowers a battery powered direct current (DC) trolling motor or troller into the water to troll for fish at 1.5 to 3 miles per hour (mph) or alternatively when casting, to slowly maneuver the boat or to maintain the boat in a relatively stationary position to counter currents and wind forces that otherwise cause the boat to drift.

Battery powered DC trolling motors are well known and may be mounted at the bow or stern of the boat. Typically, however, the troller is mounted at the bow because bow-mounted trollers allow for greater maneuverability and responsiveness of the boat compared to stern or transom mounted trollers. While existing commercially available trollers are adequate and serve the intended purpose for most anglers, that is not the case for most bowfishing enthusiasts, whether they are freshwater shooters or saltwater shooters.

Bowfishers often take their boats through strong tidal or river currents and they prefer to cover a lot of area to find fish "hotspots". In doing so, they often run their trolling motors at high speeds for extended periods of time—for which trolling motors are not designed. As a result, it is not uncommon for bowfishers to burn out their trolling motors in a single day or a single night of bowfishing. For that reason, many trolling motor manufacturers have provisions in their warranty policies that will void the warranty if the trolling motor is used for bowfishing.

Despite the risk of voiding the warranties and repeatedly burning them out, trolling motors remain the most popular means of propulsion among bowfishers for several reasons. First, because trolling motors are battery powered, they run much quieter and create less turbulence compared to gas powered outboard motors so there is less tendency to frighten fish away. Second, trolling motors are relatively inexpensive. For example, a new tiller-handle trolling motor can be purchased for under $1000, and even foot-pedal-controlled trollers, that are fully loaded with the latest features can be purchased for around $3000. The most popular troller used by bowfishers is a 36 volt, 112 pound tiller-handle-controlled troller that costs about $1,300-$1,500. Third, trolling motors are easy to mount on any boat, with most fishing boats factory designed for bow-mounted trollers. Fourth, trolling motors are easy to use and allow the boat to be highly maneuverable around obstacles.

While trolling motors provide the above advantages, they also have several disadvantages. One of the disadvantages is their power consumption. Most trolling motors used by bowfishers are 36 volt or 48 volt systems. A 36 volt troller requires three 12 volt DC batteries connected in parallel. A 48 volt troller requires four 12 volt DC batteries connected in parallel. The cost of a single 12 volt deep cycle marine battery is over $100 and better quality ones can exceed $200. The batteries can become drained within just a few hours running the trolling motors at high speeds, requiring several hours to fully recharge before they can be used again. To avoid draining their batteries so quickly, many bowfishers will use a portable gas powered generator on their boats to try to keep their batteries charged, but running a gas powered generator is loud and may be prohibited in certain noise restricted areas, especially at night when many bowfishers prefer to go shooting.

The biggest disadvantage of using commercially available DC battery-powered trollers is maintenance. As stated above, because bowfishers tend to operate their trollers under conditions for which they were not designed (i.e., at high speeds for extended periods of time), it is not uncommon for a bowfisher to have to rebuild the troller two to four times a year. Rebuilding the troller may involve replacing the armature, brushes and electronic control boards at a cost of up to $800 or more for each rebuild.

Another disadvantage of commercially available DC battery powered trollers is that they are not the greatest in vegetation and the shaft of the trollers often break. Bowfishers will often pursue fish in shallow water with dense vegetation and other underwater obstacles, including rocks, and downed trees or branches. Despite some trollers being marketed as having "unbreakable" shafts, bowfishers can attest that the so-called unbreakable shafts are not, especially when the troller is being operated at their highest speed when hitting obstacles in shallow water.

Because of the above disadvantages associated with commercially available DC battery powered trollers, some bowfishers have opted for fan boats or airboats. While airboats are very efficient in covering a lot of area quickly and are great for passing through shallow flats and vegetation and over submerged obstacles, airboats are very loud and cannot be used in many areas due to noise restrictions, especially at night. Additionally, airboats are very tall compared to conventional fishing boats so they cannot pass under low bridges or low obstacles, so they are completely impractical in many bowfishing situations. Airboats are also very heavy so they are more difficult to trailer and transport than a conventional fishing boat. Furthermore, many bowfishers who use airboats will often equip their airboats with a trolling motor to provide the desired maneuverability once the airboat gets to a hotspot, so the above-identified drawbacks associated with conventional DC battery-powered trollers are often still present when using airboats.

Other bowfishers have tried to add a "kicker" motor to their fishing boat as a supplemental means of propulsion when cruising to find fish or when operating in strong currents. A kicker motor is simply a small gas powered outboard motor, typically under 25 horsepower (hp). These kicker motors are typically mounted on the stern of the boat with a standoff jack plate next to the main outboard. The standoff jack plate allows the kicker motor to be raised for running in shallow water and helps to minimize cavitation when the prop is raised above the bottom of the boat. The kicker motor is not intended as the primary means of propulsion for the boat, nor is it intended to get the boat on plane, but is instead intended to allow the bowfisher to cruise at a faster speed than is capable with a conventional DC battery-powered trolling motor while the bowfisher is on the search for fish. Thus, while a kicker motor provides the advantage of faster speeds when searching for fish, a kicker motor has a number of other drawbacks. First, even a low horsepower gas powered outboard motor is considerably more expensive than a trolling motor. Second, a gas powered motor is louder and produces more turbulence than an DC battery-powered troller and may frighten the fish away. Third, because the kicker motor is stern mounted it does not provide the desired maneuverability and response times that a bow mounted troller provides. Fourth, because kicker motors are water cooled, they are not ideal propulsion systems for passing through muck and vegetation because the water inlet can become clogged, resulting in the kicker motor overheating. Fifth, a stern mounted kicker motor cannot be operated from the bow of the boat by the shooter without an expensive control and steering setup that can exceed the cost of the kicker motor itself. Commercially available control and steering setups to permit a stern mounted kicker motor to be controlled from the bow of the boat, ranges from $3,000 to $10,000. Many of these commercially available setups for bow-control of a stern mounted kicker motor include auto pilot and Global Positioning Systems (GPS) features desired by anglers who troll fish, but such features are typically not necessary or desired by bowfishers. Finally, even for bowfishers who install kicker motors for improved cruising speeds, such bowfishers will often add bow mounted DC battery-powered trollers for the improved maneuverability they desire. Thus, the drawbacks associated with commercially available trolling motors are often still present when using kicker motors, not to mention the additional cost of equipping the boat with both a kicker motor and a troller.

Accordingly, there has been a long felt but unresolved need among bowfishers in particular, but also from some anglers, for a trolling motor that can be operated at high speeds for extended period of time, that performs better in dense vegetation, and that is sufficiently robust to avoid or minimize damage upon encountering obstacles in shallow water. There is also a need for powering the trolling motors for extended periods without requiring expensive batteries that drain in a matter of hours during use.

DETAILED DESCRIPTION

Figure 1:
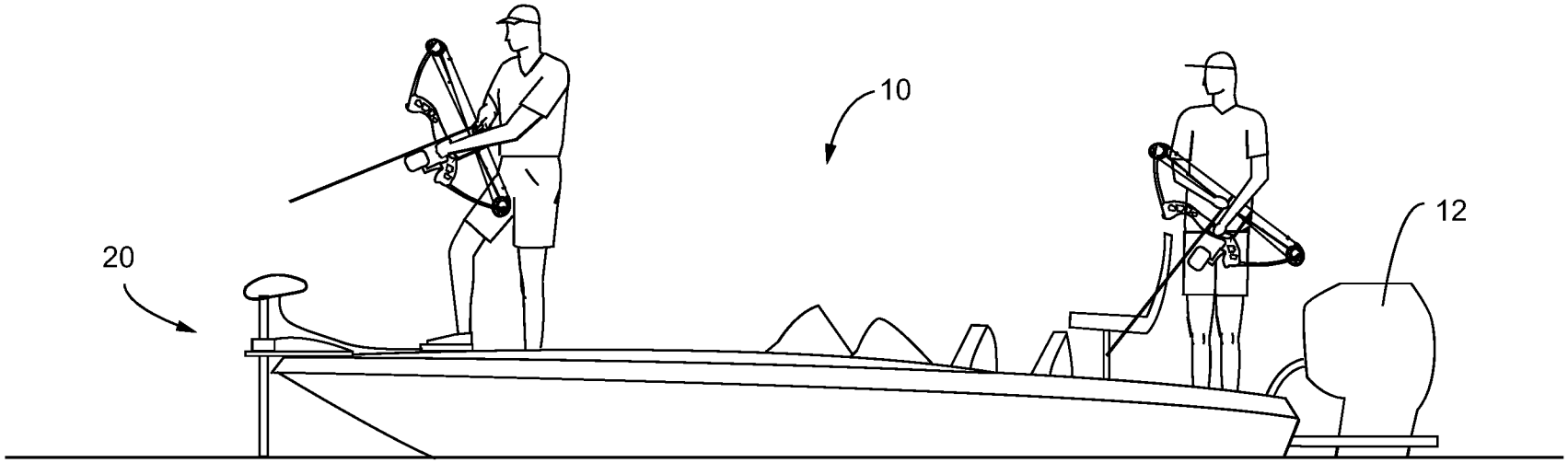
FIG. 1 is an example of a fishing boat with an outboard motor and bow mounted trolling motor.

Referring now to the drawings, wherein like reference numerals designate the same or corresponding parts throughout the several views, FIG. 1 illustrates an example of a fishing boat 10 equipped with an outboard motor 12 and a bow-mounted trolling motor or troller 20. Trollers 20 typically have either a tiller-handle for hand control or a foot control. More recently, wireless hand-held remote controls have been introduced.

Figure 2:
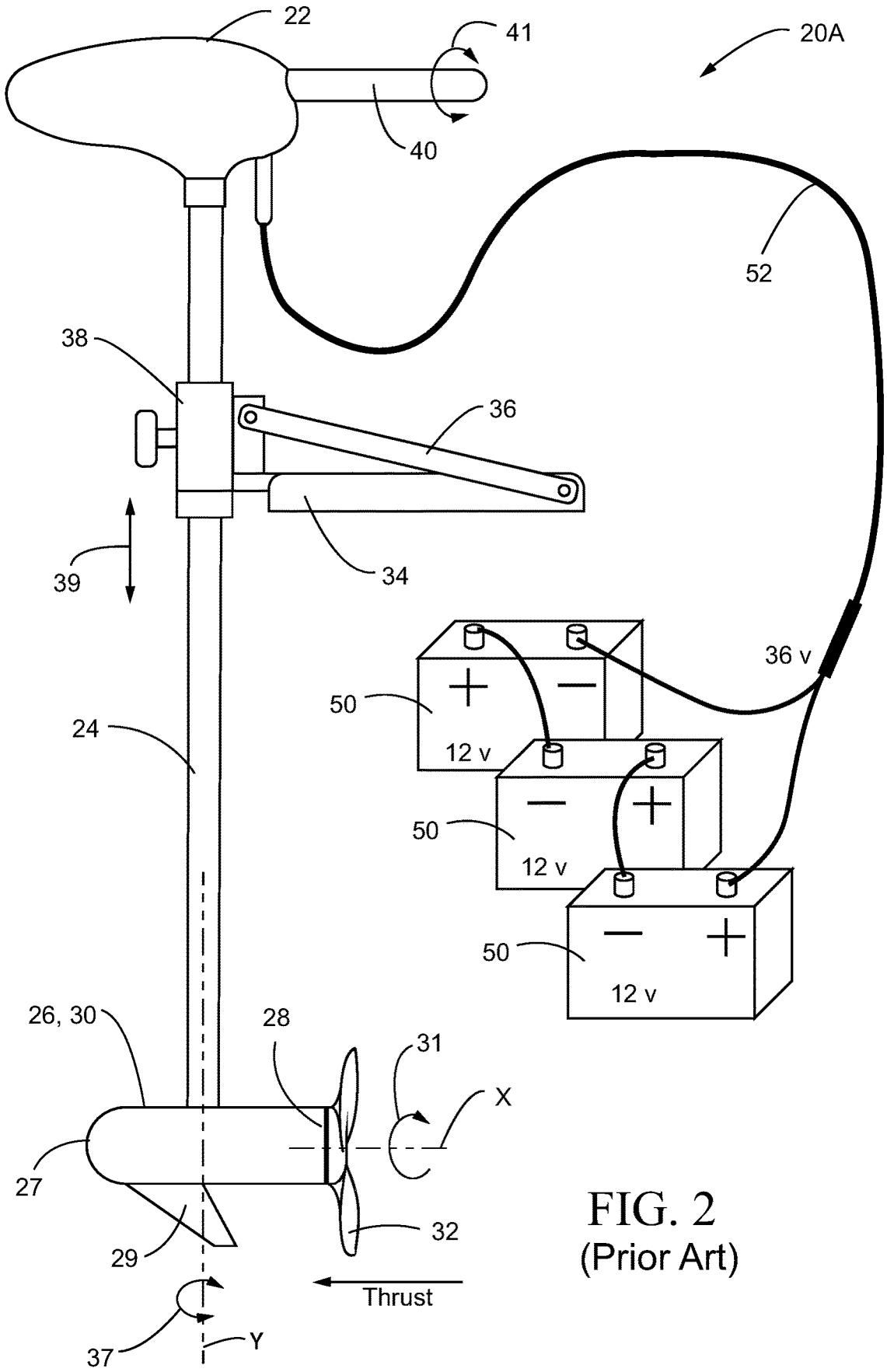
FIG. 2 (Prior Art)
FIG. 2 is an example of a conventional 36 volt, DC-powered trolling motor with a tiller handle and showing three 12 volt DC batteries connected in parallel to produce 36 volts to power the trolling motor.

FIG. 2 illustrates an example of a conventional 36 volt DC battery-powered, tiller-handle troller 20A. The tiller-handle troller 20A includes a control box or head 22 secured to an upper end of an elongated hollow shaft 24. A motor housing 26 is secured to a lower end of the hollow elongated shaft 24. The motor housing 26 has a leading end 27 and a trailing end 28. A DC motor 30 is disposed within the motor housing 26. The DC motor 30 rotatably drives the propeller or prop 32 secured to a motor drive shaft (not shown) extending from the motor housing 26 toward the trailing end 28. As the prop 32 rotates about the axis X of the drive shaft as indicated by arrow 31, it produces a thrust in the direction toward the leading end 27 of the motor housing 26. A skeg 29 may extend downwardly from the motor housing 26 to protect the prop 32 from damage during use.

A mounting bracket 34 is configured to mount to the bow of the boat as shown in FIG. 1. The troller 20A is hingedly supported from the mounting bracket 34 by a mounting arm 36 which permits the troller 20A to be moved from the deployed position (shown) to a stowed position (not shown). In the stowed position, the lower end of the troller 20A is lifted out of the water and the mounting arm 36 pivots such that elongated shaft 24 is substantially parallel with the mounting bracket 34. In the deployed position, the elongated shaft 24 is typically disposed such that it is substantially vertical or perpendicular to the mounting bracket 34 as shown. While in the deployed position, the elongated shaft 24 may also be positioned at intermediate angled positions relative to vertical.

The elongated shaft 24 is rotatably supported by a hub or collar 38 attached to the mounting arm 36 such that the troller 20A is able to rotate about the longitudinal axis Y of the elongated shaft as indicated by arrow 37 substantially 180 degrees in either direction. The elongated shaft 24 is typically vertically restrained, but in some commercially available trollers, the elongated shaft 24 is vertically adjustable relative to the mounting arm 36 as indicated by arrow 39. A spring biased break-away (not shown) may be incorporated on the mounting arm 36 or mounting bracket 34 to allow the elongated shaft 24 to move or pivot with respect to the mounting arm 36 or mounting bracket 34 in the event the motor housing 26 or elongated shaft 24 encounters an underwater obstacle so as to minimize the chance of the elongated shaft 24 bending or breaking.

A tiller handle 40 extends from the head 22. The tiller handle 40 is used for both steering and controlling the speed or thrust of the troller 20A. To steer the troller 20A, the tiller handle 40 is moved from side-to-side causing the elongated shaft 24 to rotate within the collar 38 about the longitudinal axis Y as indicated by arrow 37 in order to direct the thrust from the prop 32 toward the desired direction of travel. The tiller handle 40 incorporates speed or thrust settings and an off setting selectable by the operator twisting the tiller handle 40 to the desired setting as indicated by arrow 41. The DC motor 30 and prop 32 rotate at the selected speed or thrust setting until the tiller handle is twisted to the off setting. Internal wires (not shown) extend from the head 22 through the hollow elongated shaft 24 to provide power and the selected speed or thrust setting to the DC motor 30. In some commercially available tiller handle trollers 20A, the tiller handle 40 includes reverse settings to cause the motor 30 and prop 32 to rotate in the opposite direction resulting in thrust toward the trailing end, opposite from that shown in FIG. 2.

In the example of the 36 volt DC battery-powered tiller-handle troller 20A of FIG. 2, the DC motor 30 is powered by three 12 volt DC batteries 50 connected in parallel to produce an output of 36 volts. It should be appreciated that the number of batteries 50 may vary from one to four batteries or more (i.e., 12 to 48 volts or more) depending on the voltage requirements to power the DC motor 30. A power cable 52 extends from the batteries 50 to the head 22.

Figure 3:
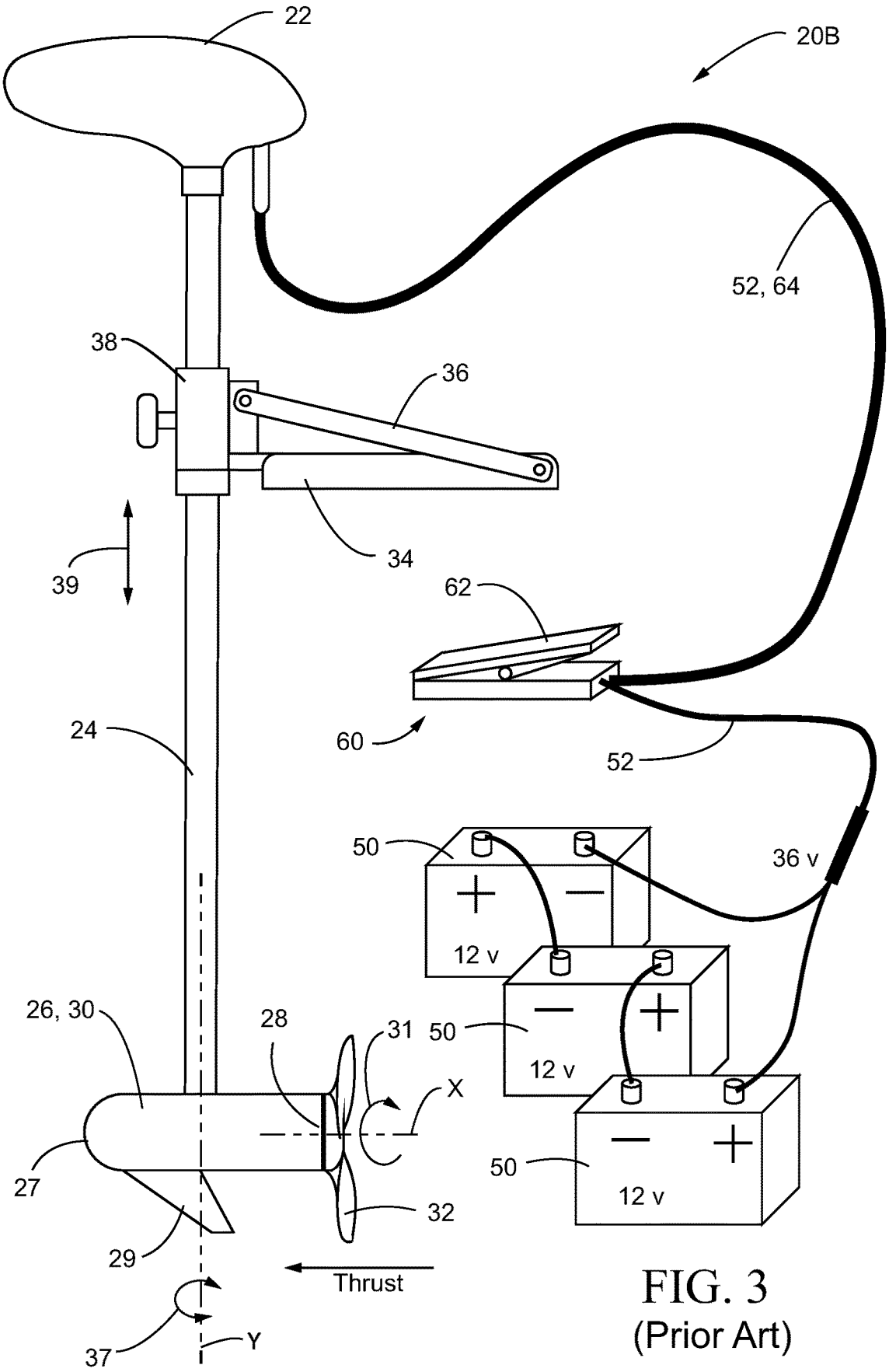
FIG. 3 (Prior Art)
FIG. 3 is an example of a conventional 36 volt, DC-powered trolling motor with a foot-controller and showing three 12 volt DC batteries connected in parallel to produce 36 volts to power the trolling motor.

FIG. 3 illustrates an example of a conventional 36 volt DC battery-powered, foot-control troller 20B. The foot-control troller 20B is similar to the tiller-handle troller 20A, except that instead of a tiller handle 40, the troller 20B is controlled using a foot-controller 60. The foot controller 60 includes a foot pedal or foot lever 62. To steer right, the operator pushes the toe of the foot lever 62 down (i.e., toe down/heel up). To steer left, the operator pushes the heel of the foot lever 62 down (i.e., heel down/toe up). The foot controller 60 may be a mechanical cable-steering system utilizing steering cables extending through a sleeve 64 between the foot lever 62 and the head 22. With such a cable-steering system, left and right steering cables are connected at one end to the foot lever 62, or to cams within the foot lever 62. The other end of the left and right steering cables is connected to pulleys or cams in engagement with gears rotationally fixed to the shaft 24 within the head 22. The position of the foot lever 62 causes the left and right steering cables to move or rotate the pulleys or cams in engagement with the gears within the head 22, which, in turn, causes the elongated shaft 24 to rotate left or right within the collar 38. Other foot controllers 60 may be electronic steering systems utilizing signal wires extending through the sleeve 64 from the foot lever 62 to the head 22. In such electronic foot-control trollers, the signal wires communicate data signals generated by one or more position sensors that detect or sense the position of the foot lever 62 to cause servo driven gears within the head 22 or collar 38 to rotate the elongated shaft 24 with respect to the collar 38. Other conventional electronic steering systems are wireless, utilizing Bluetooth, Wi-Fi or other wireless data communication system to communicate steering commands between the foot controller 60 and servo driven gears within the head 22 or collar 38 to rotate the elongated shaft 24 with respect to the collar 38.

The speed of the DC motor 30 is typically controlled by a dial (not shown) on the foot controller 60. The foot controller 60 also typically includes a switch with an "on/continuous" position and an "off" position. When in the "on/continuous" position, the DC motor 30 runs continuously at the preselected speed until switched to the "off" position. Some foot controllers 60 also have a "momentary" position wherein the motor runs at the preselected speed for a short period before automatically shutting off the motor 30. A power cable 52 extends from the batteries 50 to the foot controller 60. Both a power cable 52 and steering cables or signal wires extend through the sleeve 64 between the foot controller 60 and the head 22. Internal wires (not shown) extend from the head 22 through the hollow elongated shaft 24 to provide power and speed control to the DC motor 30. In all other respects, the structural components, power supply and operation for the foot-control troller 20B is substantially the same as the tiller-handle troller 20A and therefore the descriptions of those same components will not be repeated.

Other commercially available trollers may be controlled with a handheld wireless remote (not shown) utilizing Bluetooth or other wireless communication system to communicate steering commands directly to the head 22 to drive servo driven gears within the head 22 or collar 38 to rotate the elongated shaft 24 with respect to the collar 38. It should be appreciated that trollers utilizing a handheld remote may be incorporated into trollers that also include either a tiller-handle or a foot control.

Figure 4:
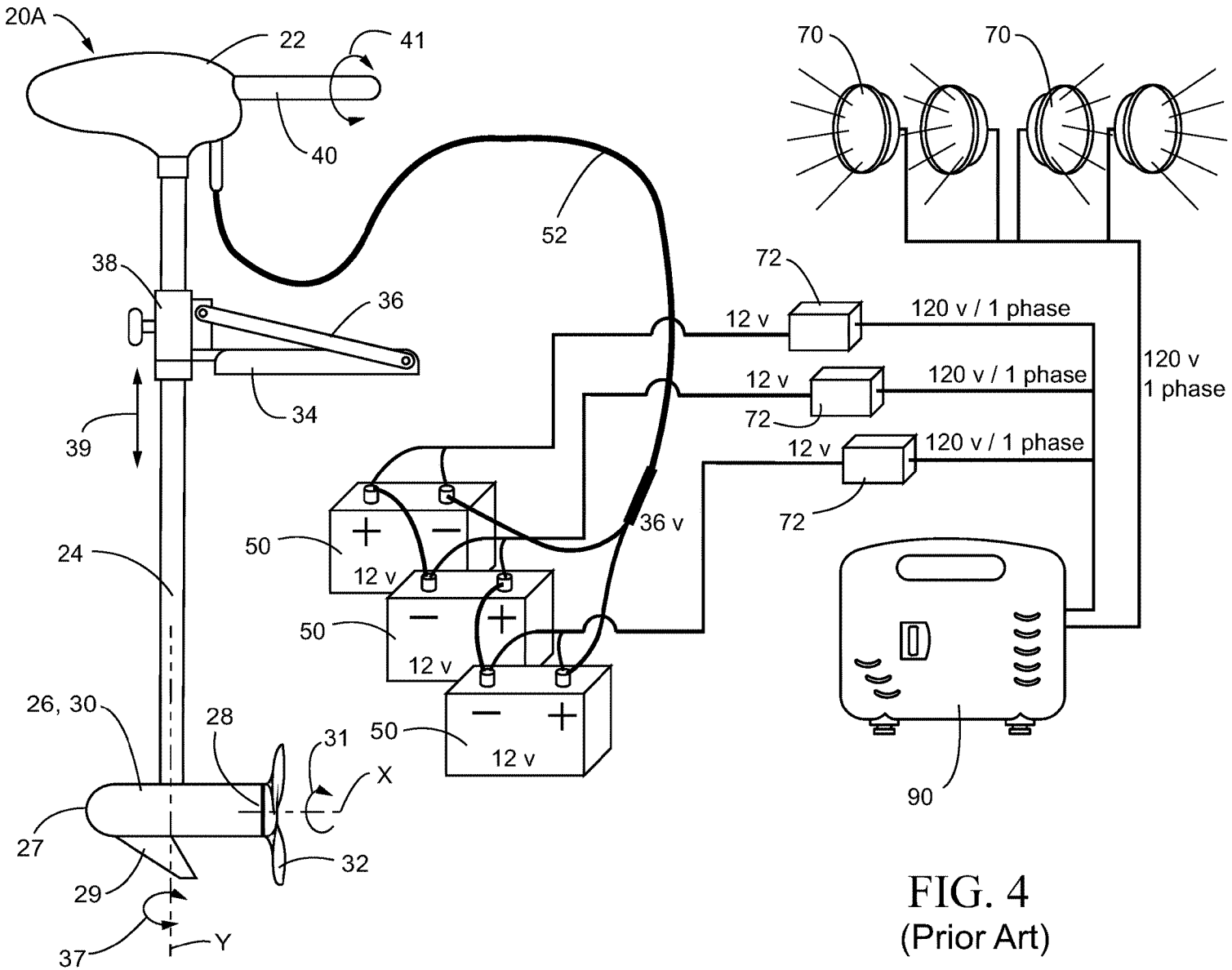
FIG. 4 (Prior Art)
FIG. 4 shows the same 36 volt, DC-powered tiller-handle troller as in FIG. 2 but showing additional accessories used by a typical bowfisher, including lights and an inverter generator for powering the lights and AC-to-DC converters for charging the troller batteries.
Figure 5:
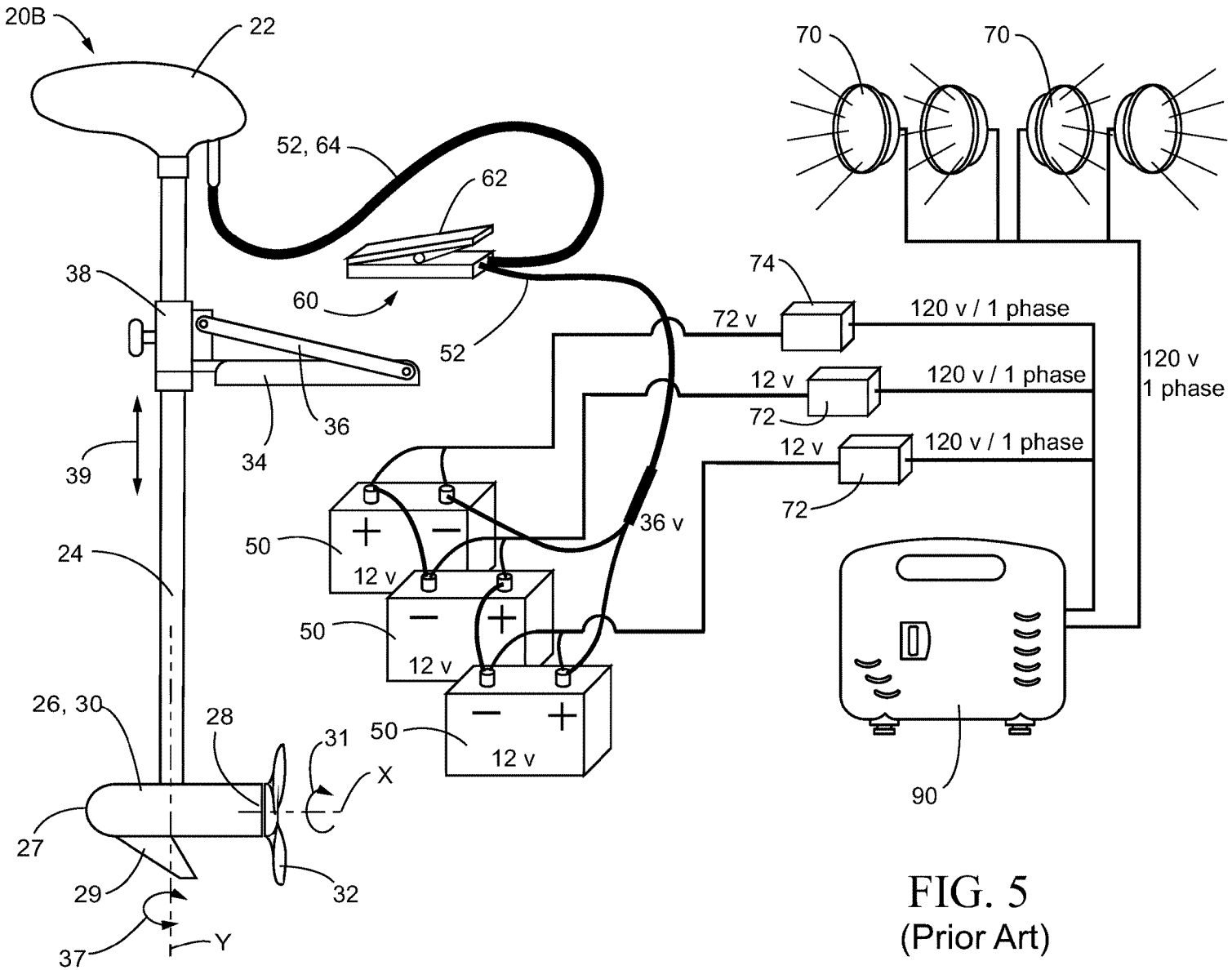
FIG. 5 (Prior Art)
FIG. 5 shows the same 36 volt, DC-powered foot-control troller as in FIG. 3 but showing additional accessories used by a typical bowfisher, including lights and an inverter generator for powering the lights and AC-to-DC converters for charging the troller batteries.

FIGS. 4 and 5 show the same 36 volt DC battery-powered trollers 20A and 20B as in FIGS. 2 and 3, respectively, but showing additional accessories used by a typical bowfisher. These additional accessories include several high lumen lights 70 for night shooting, an inverter generator 90 for powering the lights 70 and an AC-to-DC converter 72 for each battery 50 for maintaining the charge on the batteries 50. Inverter generators 90 are desirable because they operate efficiently at relatively low noise levels and they generate a stable AC output. A popular inverter generator 90 used by bowfishers is a gasoline powered inverter generator that outputs 120 volt, single-phase AC current because it can directly power the lights 70. The AC-DC converters 72 are necessary to convert the 120 volt AC output of the inverter generator 90 to 12 volt DC current to maintain the charge on the 12 volt DC batteries 50.

Based on all of the foregoing, it should be appreciated that the costs associated with using DC-powered trollers 20A, 20B is significant, especially when combined with the costs of the accessory equipment typically used with DC powered trollers (i.e., batteries 50, lights 70, inverter generator 90 and multiple AC-DC converters 72). And with, or despite, these high costs, DC powered trollers 20A, 20B often burn out or otherwise fail requiring repeated rebuilds over the course of a bowfishing season costing up to $800 for each rebuild. Accordingly, bowfishers in particular have been begging for an alternative propulsion solution that provides the maneuverability of bow-mounted trollers, but which is capable of providing the speed of a kicker motor, and which is robust so that it can be used for long periods of time at high speeds without failing or burning out and which can power through weeds and shallow water.

Figure 6:
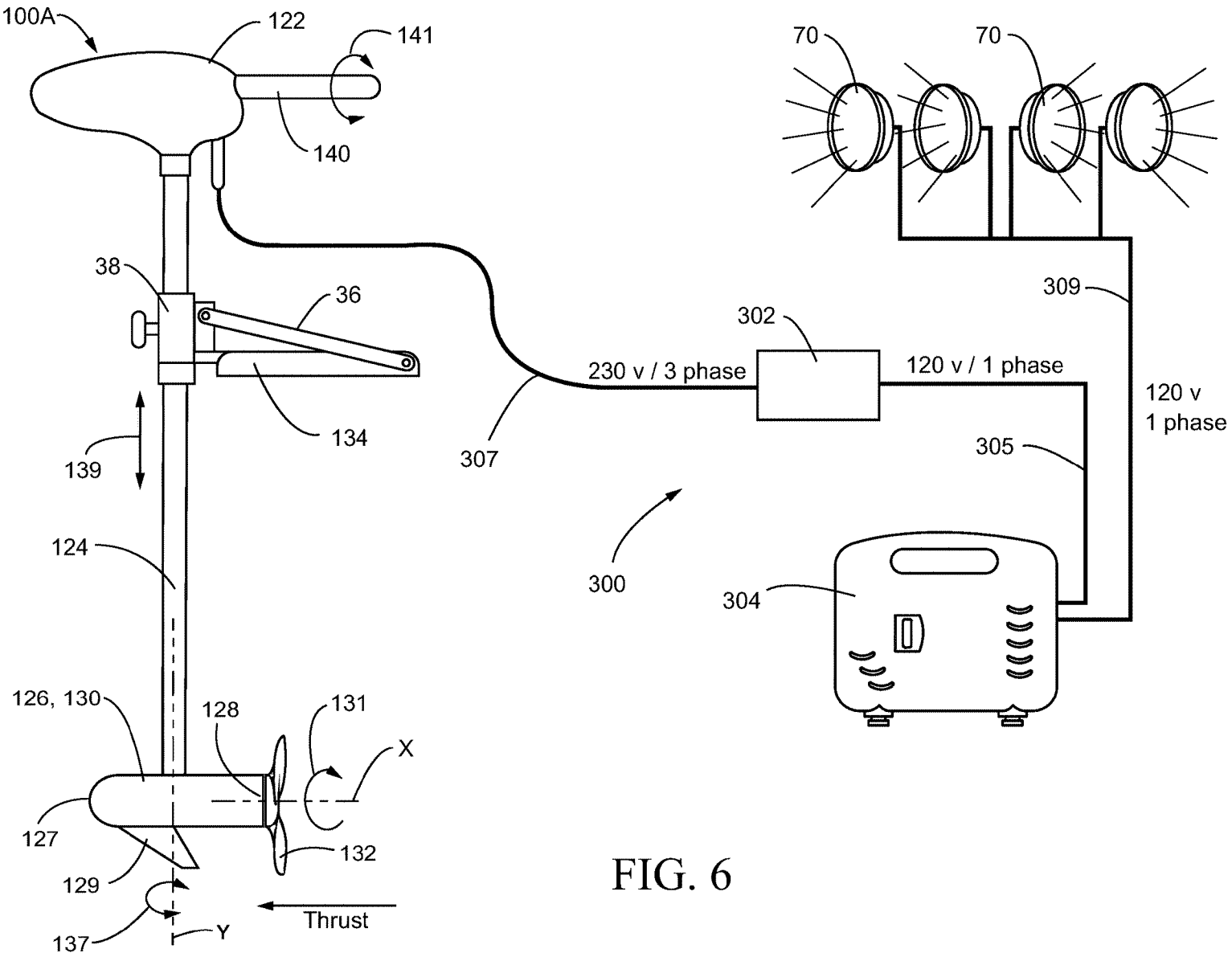
FIG. 6 is an embodiment of an AC-powered troller with a tiller handle and showing an embodiment of an AC power system for powering the AC troller, lights or other accessories.

To satisfy this long-felt but unresolved need, Applicant has developed an AC propulsion system that utilizes an AC-motor for the troller which is powered by an AC power system. FIG. 6 is an embodiment of an AC powered, tiller-handle troller 100A with an AC power system 300. Similar to the DC-powered tiller-handle troller 20A, the AC-powered tiller-handle troller 100A includes a control box or head 122 secured to an upper end of an elongated hollow shaft 124. A motor housing 126 is secured to a lower end of the hollow elongated shaft 124. The motor housing 126 has a leading end 127 and a trailing end 128. An AC motor 130 is disposed within the motor housing 126. The AC motor 130 rotatably drives the propeller or prop 132 secured to a motor drive shaft (not shown) extending from the motor housing 126 toward the trailing end 128. As the prop 132 rotates about the axis X of the drive shaft as indicated by arrow 131, it produces a thrust in the direction toward the leading end 127 of the motor housing 126. A skeg 129 may extend downwardly from the motor housing 126 to protect the prop 132 from damage during use.

A mounting bracket 134 is configured to mount to the bow of the boat as shown in FIG. 1. The AC-powered tiller-handle troller 100A is hingedly supported from the mounting bracket 134 by a mounting arm 136 which permits the troller 100A to be moved from the deployed position (shown) to a stowed position (not shown). In the stowed position, the lower end of the troller 100A is lifted out of the water and the mounting arm 136 pivots such that elongated shaft 124 is substantially parallel with the mounting bracket 134. In the deployed position, the elongated shaft 124 is typically disposed such that it is substantially vertical or perpendicular to the mounting bracket 134 as shown. While in the deployed position, the elongated shaft 124 may also be positioned at intermediate angled positions relative to vertical.

The elongated shaft 124 is rotatably supported by a hub or collar 138 attached to the mounting arm 136 such that the troller 100A is able to rotate about the longitudinal axis Y of the elongated shaft as indicated by arrow 137 substantially 180 degrees in either direction. The elongated shaft 124 may be vertically restrained, or the elongated shaft 124 may be vertically adjustable relative to the mounting arm 136 as indicated by arrow 139. A spring biased break-away (not shown) may be incorporated on the mounting arm 136 or mounting bracket 134 to allow the elongated shaft 124 to move or pivot with respect to the mounting arm 136 or mounting bracket 134 in the event the motor housing 126 or elongated shaft 124 encounters an underwater obstacle so as to minimize the chance of the elongated shaft 124 bending or breaking.

The AC-powered tiller-handle troller 100A, includes the tiller handle 140 extending from the head 122. The tiller handle 140 is used for both steering and controlling the speed or thrust of the troller 100A. To steer the troller 100A, the tiller handle 140 is moved from side-to-side causing the elongated shaft 124 to rotate within the collar 318 about the longitudinal axis Y as indicated by arrow 137 in order to direct the thrust from the prop 132 toward the desired direction of travel. The tiller handle 140 incorporates speed or thrust settings and an off setting selected by the operator twisting the tiller handle 140 to the desired setting as indicated by arrow 141. The AC motor 130 and prop 132 rotate at the selected speed setting or thrust setting until the tiller handle is twisted to the off setting. Internal wires (not shown) extend from the head 122 through the hollow elongated shaft 126 to provide power and the selected speed or thrust setting to the AC motor 130. The tiller handle 40 may include reverse settings to cause the AC motor 130 and prop 132 to rotate in the opposite direction resulting in thrust toward the trailing end, opposite from that shown in FIG. 6. The AC-powered tiller-handle troller 100A may be substantially the same as a 36 volt, 112 lb., Minn Kota tiller-handle troller except with the DC motor and DC power source used with the 36 volt, 112 lb., Minn Kota troller replaced with the AC motor 130 and AC power system 300 as described later.

Figure 7:
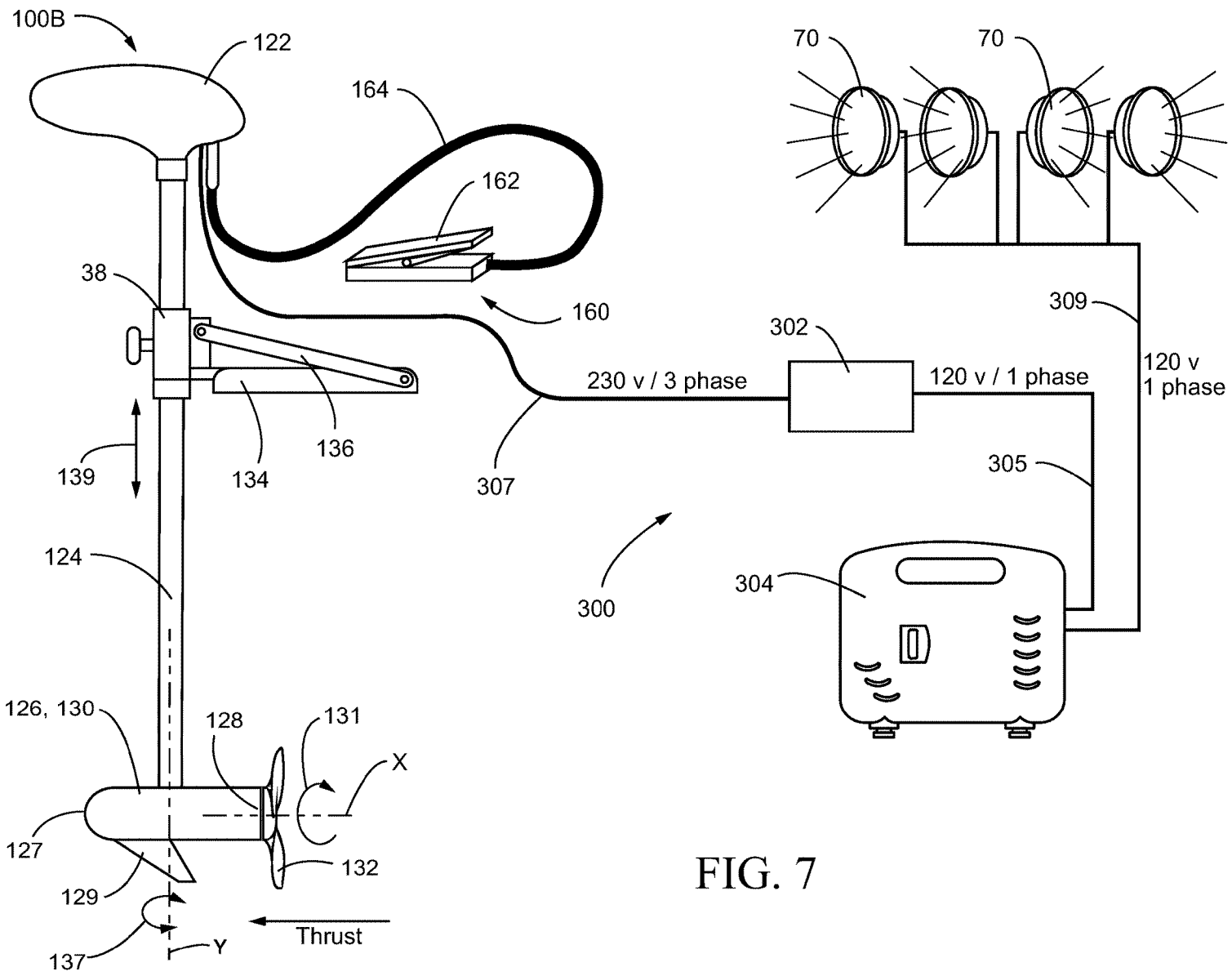
FIG. 7 is an embodiment of an AC-powered troller with a steering-cable or wired foot controller and showing an embodiment of an AC power system for powering the AC troller, lights or other accessories.

FIG. 7 illustrates an embodiment of an AC-powered, foot-control troller 100B. The AC powered, foot-control troller 100B is similar to the AC-powered tiller-handle troller 100A, except that instead of a tiller handle 140, the troller 100B is controlled using a foot-controller 160. The foot controller 160 includes a foot pedal or foot lever 162. To steer right, the operator pushes the toe of the foot lever 162 down (i.e., toe down/heel up). To steer left, the operator pushes the heel of the foot lever 162 down (i.e., heel down/toe up). The foot controller 160 may be a mechanical cable-steering system utilizing steering cables extending through a sleeve 164 between the foot lever 162 and the head 122. With such a cable-steering system, left and right steering cables are connected at one end to the foot lever 162, or to cams within the foot lever 162. The other end of the left and right steering cables is connected to pulleys or cams in engagement with gears rotationally fixed to the shaft 124 within the head 122. The position of the foot lever 162 causes the left and right steering cables to move or rotate the pulleys or cams in engagement with the gears within the head 122, which, in turn, causes the elongated shaft 124 to rotate left or right within the collar 138. In all other respects, the structural components of the foot-control troller 100B is substantially the same as the AC-powered tiller-handle troller 100A and therefore the descriptions of those same components will not be repeated. The AC-powered foot-control troller 100B with steering cables may be substantially the same as the 36 volt, 112 lb., Minn Kota foot-control troller with steering cables except with the DC motor and DC power source used with the 36 volt, 112 lb., Minn Kota troller replaced with the AC motor 130 and AC power system 300 as described later.

In an alternative embodiment, instead of using steering cables extending through the sleeve 164 between the foot lever 162 to the head 122, the foot controller 160 may be an electronic steering system, utilizing signal wires extending through the sleeve 164 between the foot lever 162 and the head 122. In such an embodiment, the signal wires communicate data signals generated by one or more position sensors that detect or sense the position of the foot lever 162 to cause servo driven gears within the head 122 or collar 138 to rotate the elongated shaft 124 with respect to the collar 138. The foot controller 160 may include a DC battery pack for providing a low voltage power to the sensors within the foot controller. Alternatively, the head may include a DC battery pack with low voltage wires running through the sleeve 164 to the foot lever 162, along with the signal wires, for providing power to the position sensors. Alternatively, the head 122 may include an AC-DC converter and transformer to convert a portion of the AC current provided by the AC power system 300 (discussed later) to provide low voltage power to the position sensors within the foot control 162. The AC-powered foot-control troller 100B with electronic steering may be substantially the same as the 36 volt, 112 lb., Minn Kota foot-control troller with electronic steering except with the DC motor and DC power source used with the 36 volt, 112 lb., Minn Kota troller replaced with the AC motor 130 and AC power system 300 as described later.

Figure 8:
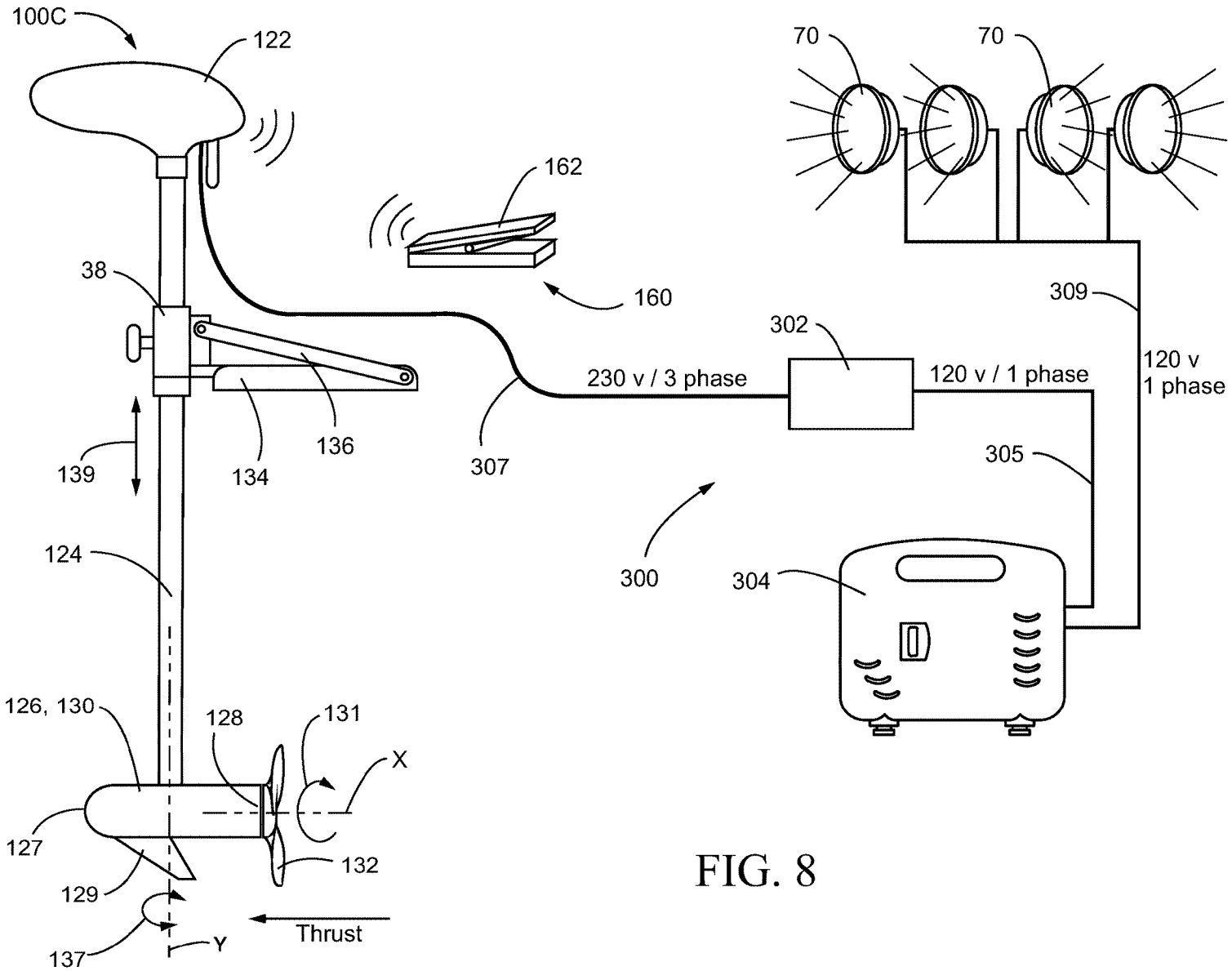
FIG. 8 is an embodiment of an AC-powered troller with a wireless foot controller and showing an embodiment of an AC power system for powering the AC troller, lights or other accessories.

FIG. 8 illustrates another embodiment of an AC-powered, wireless foot-control troller 100C. The AC-powered wireless foot-control troller 100C is substantially the same as the wired foot-control troller 100B except that the sleeve 164 containing the steering cables or signal wires is eliminated. Instead the signals generated by the position sensors detecting or sensing the position of the foot lever 162 are communicated via Bluetooth, Wi-Fi or other wireless data communication system to a wireless receiver in the head 122. The generated signals wireless communicated to the head 122 are converted to steering commands to control actuation of servo driven gears within the head 122 or collar 138 to rotate the elongated shaft 124 with respect to the collar 138. In all other respects, the wireless foot control troller 100C is the same as the wired foot control troller 100B and therefore the descriptions of those same components will not be repeated. The AC-powered wireless foot-control troller 100C may be substantially the same as the 36 volt, 112 lb., Minn Kota wireless foot-control troller except with the DC motor and DC power source used with the 36 volt, 112 lb., Minn Kota troller replaced with the AC motor 130 and AC power system 300 as described later.

Figure 9:
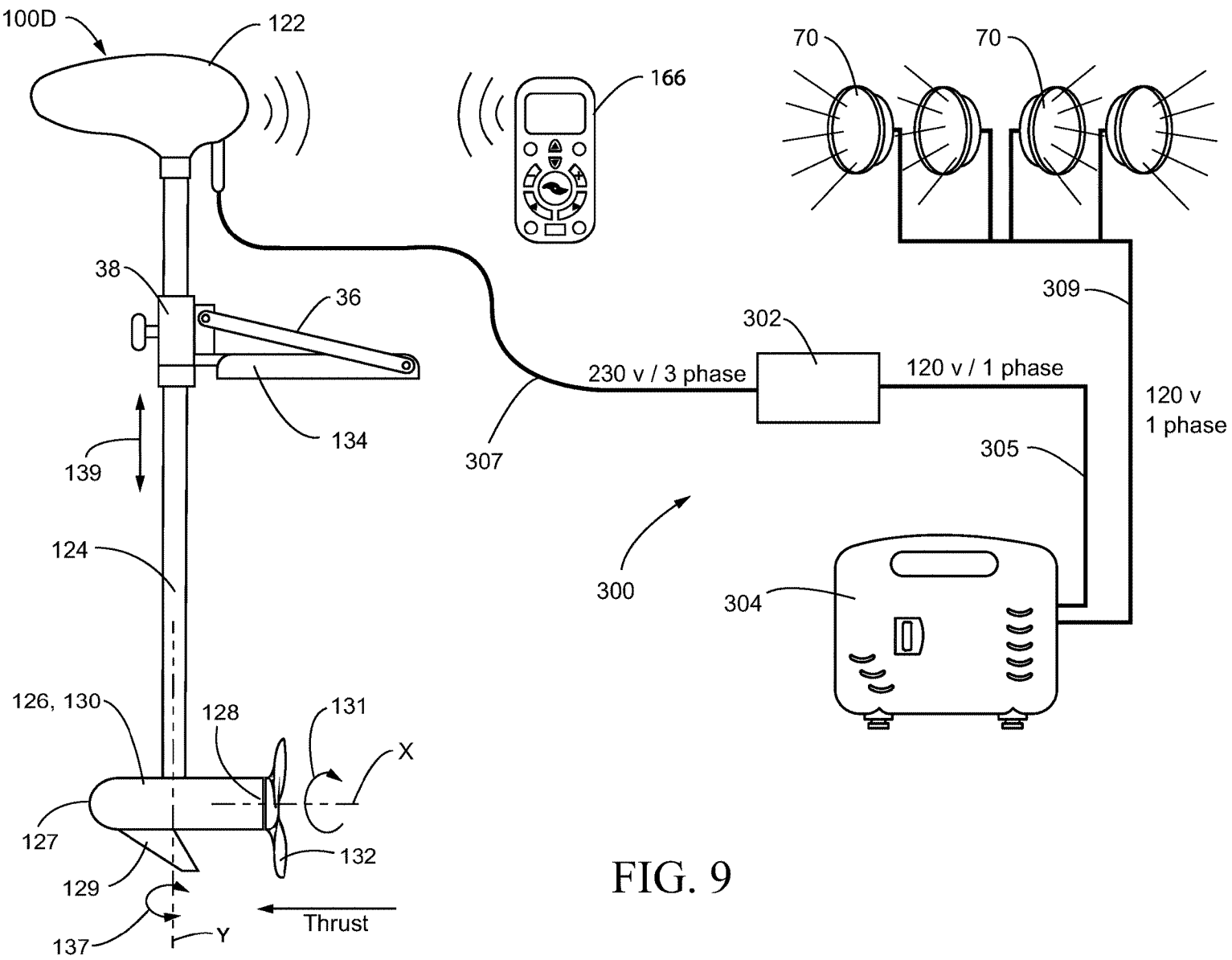
FIG. 9 is an embodiment of an AC-powered troller with a wireless handheld remote and showing an embodiment of an AC power system for powering the AC troller, lights or other accessories.

FIG. 9 illustrates an embodiment of an AC powered, remote-controlled troller 100D. The AC-powered remote controlled troller 100D is substantially the same as the wireless foot-control troller 100C except that wireless foot controller 160 is eliminated and replaced with a handheld wireless remote 166. The wireless handheld remote communicates steering communicated signals wirelessly via Bluetooth, Wi-Fi or other wireless data communication system to a wireless receiver in the head 122 to control actuation of servo driven gears within the head 122 or collar 138 to rotate the elongated shaft 124 with respect to the collar 138. In all other respects, the AC-powered remote controlled troller 100D is the same as the wireless foot-control troller 100B and therefore the descriptions of those same components will not be repeated. The AC-powered remote-controlled troller 100D may be substantially the same as the 36 volt, 112 lb., Minn Kota remote-controlled troller except with the DC motor and DC power source used with the 36 volt, 112 lb., Minn Kota troller replaced with the AC motor 130 and AC power system 300 as described later.

For each of the embodiments, 100B, 100C, 100D, the speed or thrust of the AC motor 30 may be controlled by a dial or other suitable speed or thrust selector (not shown) on the foot controller 160 or handheld remote 166. The foot controller 160 or handheld remote may include a switch with an "on/continuous" position and an "off" position. When in the "on/continuous" position, the AC motor 130 runs continuously at the preselected speed until switched to the "off" position. The foot controller 160 or handheld remote 166 may also have a "momentary" position wherein the motor runs at the preselected speed for a short period before automatically shutting off. In the cable-steered or wired foot-control embodiments 100B, 100C, the steering cables or signal wires extend through a sleeve 164 extending from the foot controller 160 to the head 122. Internal wires (not shown) extend from the head 122 through the hollow elongated shaft 124 to provide power and speed or thrust control to the AC motor 130.

For all embodiments of the AC-powered trollers 100A, 100B, 100C, 100D, the AC power system 300 includes a variable frequency drive (VFD) 302 and a generator 304 to power the AC motor 130. The generator 304 may be a conventional generator or an inverter generator. The VFD 302 is electrically coupled to the generator 304 via a suitable power line 305 extending between a VFD AC input connection of the VFD 302 and an AC output connection of the generator 304. The VFD 302 is electrically coupled to the AC motor 130 of the AC-powered trollers 100A, 100B, 100C, 100D via a suitable power line 307 extending between a VFD output connection of the VFD 302 and the head 122 before ultimately connecting through intermediate wires extending through the hollow elongated shaft 124 to an AC input connection of the AC motor 130. The lights 70 are electrically coupled to the generator 304 via power line 309.

The generator 304 is configured to generate an AC output of a defined nominal voltage and phase at its AC output connection. The VFD 302 is matched to both the generator 304 and the AC motor 130 such that the nominal AC voltage and phase input of the VFD 302 corresponds to the nominal AC voltage and phase output generated by the generator 304 and the nominal AC voltage and phase output of the VFD 302 corresponds to the defined nominal AC voltage and phase input of AC motor 130. The VFD 302 is also configured to vary the voltage and frequency (hertz) output depending on the speed or thrust selected by operator and other loading conditions. For example, frequency is directly related to the motor's speed or revolutions per minute (RPM). The higher the frequency, the faster the AC motor's RPMs. Reducing the frequency to slow the motor speed reduces the voltage proportionally to maintain a relatively constant volts per hertz (V/Hz) ratio. Likewise if the motor speed is increased, the voltage is increased proportionally to maintain a relatively constant V/Hz ratio. Thus, if the troller 100A, 100B, 100C, 100D is being operated at a lower speed or thrust selection, the VFD 302 will ramp down the voltage and frequency proportionally to meet the requirements of the AC motor's load. If, however, the operator has selected the highest speed or thrust setting, or if the troller 100A, 100B, 100C, 100D is passing through dense vegetation, or muddy shallow water resulting in more load on the AC motor 130, the VFD 302 will increase the voltage and frequency proportionally to meet the higher speed or load conditions of the AC motor 130.

In sizing the AC motor, Applicant desired to have an AC motor that was capable of producing a thrust comparable to the largest DC-powered trolling motor available on the market which produces 112 pounds of thrust. Based on this criteria, Applicant chose a 2 hp, 230 volt, three-phase, brushless, submersible, water cooled AC motor. The AC motor may be stainless steel encased to minimize corrosion. A suitable AC motor meeting the above specifications includes is pump model number 2343159204G available from Franklin Electric Co., Inc., 9255 Coverdale Road, Fort Wayne, Indiana 46809, USA. The power requirements of the selected AC motor dictates the output requirements of the generator 304 and VFD 80. For a 2 hp, 230 volt, three-phase AC motor, Applicant has found that a 120 volt, single-phase, 3500 watt Predator™ inverter generator available from Harbor Freight Corporation, 3491 Mission Oaks Blvd, Camarillo, California 93012-5034, USA, is suitable, as it provides the necessary voltage and amperage requirements while operating efficiently at relatively low noise levels. A suitable VFD 302 capable of converting the 120 volt, single-phase AC output of the above-referenced inverter generator 304 to 230 volt, three-phase AC for operating the 2 hp, 230 volt, three-phase AC motor 130 is a VFD model number KBDF-27D available from KB Electronics, Inc., 12095 Northwest 39th Street Coral Springs, Florida 33065, USA.

It should be understood that all voltage references used herein are nominal voltages. Thus, for example, any reference to 120 volts includes the typical range of 110/120 volts variable by about +5% to about −5%, or from about 105 to about 125 volts. Likewise, for example, any reference to 220, 230 or 240 volts herein includes the typical range of 220/240 volts variable by about +5% to about −5%, or from about 210 volts to about 250 volts.

Applicant converted a 36 volt, 112 lb., DC-powered Minn Kota Riptide, tiller handled troller, to utilize a 2 hp, 230 volt, three-phase AC motor 130 (hereinafter the "Converted AC-Powered Troller 100A") coupled with the AC power system 300 identified above (i.e., the VFD 302 and inverter generator 304). In field testing, the Converted AC-Powered Tiller-Handled Troller 100A coupled with the AC power system 300 provided at least a 30 percent increase in speed over the conventional 36 volt, 112 lb., DC-powered Minn Kota Riptide tiller handled troller. Applicant also replaced the standard 11 inch diameter prop of the 36 volt, 112 lb., DC-powered Minn Kota Riptide, tiller handled troller 20A with a 6 inch diameter prop; thus decreasing the prop size by nearly half. In field testing the Converted AC-Powered Tiller-Handled Troller 100A with the smaller prop 132, Applicant was able to pass through much shallower water and found that the smaller prop 132 proved to be extremely weedless, outperforming the conventional 36 volt, 112 lb., DC-powered Minn Kota Riptide, tiller handled troller 20A with standard 11 inch diameter prop in its ability to pass through vegetation with much less fouling. Applicant attributes the improved weedless performance and increased speed to the lower torque requirement of the smaller prop and greater power provided by the 2 hp AC motor 130 of the Converted AC-Powered Tiller-Handled Troller 100A.

Additionally, during field testing of the Converted AC-Powered Tiller-Handled Troller 100A with the AC power system 300 as described herein, it was found that the Converted AC-Powered Tiller-Handled Troller 100A used less amps from the inverter generator 304 than the conventional 36 volt, 112 lb., DC-powered Minn Kota Riptide tiller handle troller, attached to three 12 volt DC batteries connected to three AC-DC converters 72 as described in connection with FIG. 4.

Furthermore, based on field testing the Converted AC-Powered Troller with the AC power system 300 as described herein and based on Applicant's past experience with operating the conventional 36 volt, 112 lb., DC-powered Minn Kota Riptide tiller-handle troller, the Converted AC-Powered Tiller-Handled Troller 100A will significantly surpasses the life of the conventional 36 volt, 112 lb., DC-powered Minn Kota Riptide tiller-handle troller.

It should also be appreciated that the AC powered trollers 100A, 100B, 100C, 100D with the AC power system 300 significantly decreases the number of components necessary, thereby decreasing the number of components that can go bad and requiring repair or replacement. The reduced number of components needed for the AC powered trollers 100A, 100B, 100C, 100D with the AC power system 300 will thus reduce costs over a typical season compared to conventional DC-powered trollers and DC power system (i.e., multiple 12 volt DC batteries 50, an inverter generator 90 and multiple AC-DC converters 72), not only in initial purchase price of the needed components, but also in the repair and replacement costs of those components, not to mention the inevitable burning out of the DC troller 20A, 20B requiring up to $800 for each needed rebuild.

Additionally, by eliminating the 12 volt DC batteries 50 (see FIGS. 2-5), each of which can weigh between 60 to 70 pounds, the AC power system 300 described herein decreases the overall weight within the boat by about 200 pounds (assuming three 12 volt batteries for a 36 volt DC-powered troller). The decrease in weight produces less stress and potential for fracture of the boat hull and reduces the thrust requirements. As a rule of thumb, there should be at least 2 lbs. of thrust for every 100 lbs. of weight of the boat. Thus, by eliminating the three 70 pound batteries alone, the thrust capacity of the AC-powered trollers with AC power system 300 is increased by 4 lbs., assuming all other weights and factors being equal.

Figure 10:
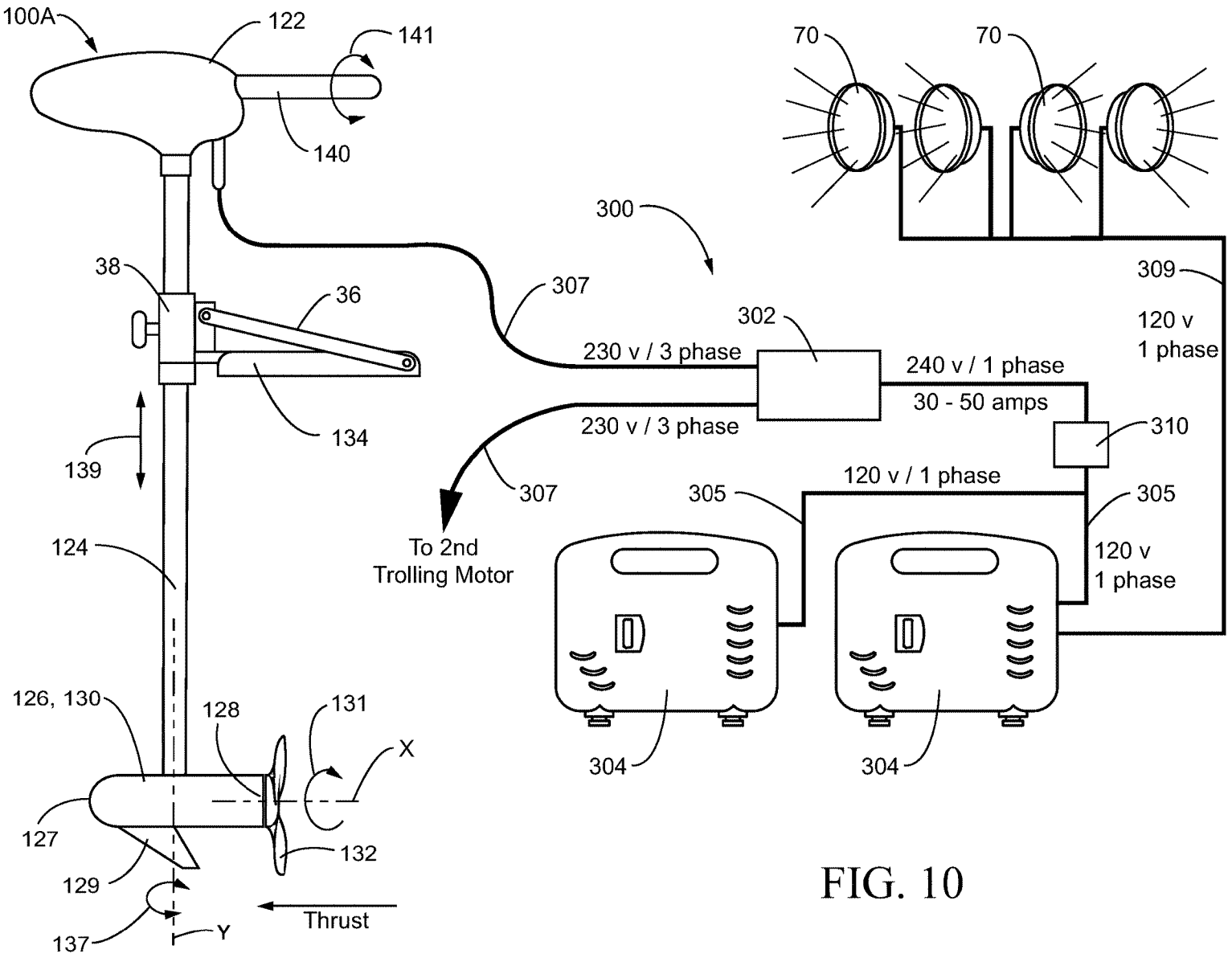
FIG. 10 is an embodiment of an AC power system showing two inverter generators connected in parallel for powering two AC trollers, lights or other accessories.

While the foregoing example of Applicant's Converted AC-Powered Troller 100A used a 2 hp AC motor, it should be appreciated that the AC powered trollers 100A, 100B, 100C, 100D may utilize smaller horsepower AC motors (e.g., 1 hp or 1.5 hp) or larger horsepower AC motors (e.g., 2.5 to 5 hp). However, AC motors that are greater than 2 hp, typically require a 240 volt input, thus requiring an inverter generator 304 that outputs 240 volts because the amperage drawn by the larger horsepower AC motors exceeds the amperage output available from a 120 volt inverter generator 304. However, because the cost of a 240 volt inverter generator is significant, it may be desirable to utilize two less expensive 120 volt inverter generators 304 connected in parallel as illustrated in FIG. 10 to produce the higher amperage output (e.g., 30 to 50 amps) needed for AC motors 130 greater than 2 hp. In such embodiments, an inline transformer 310 is simply added to convert the 120 volt, 30 to 50 amp output of the two parallel connected inverter generators 304 so that a 240 volt input is provided to the VFD 302. In reference to FIG. 10, it should be appreciated that utilizing a larger inverter generator or coupling two smaller inverter generators in parallel allows the addition of a second AC-powered troller 100A, 100B, 100C, 100D as a pusher motor which may be mounted to the transom or stern of the boat if more speed is desired.

The foregoing description and drawings are intended to be illustrative and not restrictive. Various modifications to the embodiments and to the general principles and features of the AC boat propulsion system described herein will be apparent to those of skill in the art. Thus, the disclosure should be accorded the widest scope consistent with the appended claims and the full scope of the equivalents to which such claims are entitled.

The invention claimed is:

1. An alternating current (AC) propulsion system for a boat, comprising:

a trolling motor operably mountable to the boat, the trolling motor including:

an elongated shaft;

a head secured at an upper end of the elongated shaft;

a motor housing secured at a lower end of the elongated shaft, the motor housing having a leading end and a trailing end;

an AC motor disposed within the motor housing, the AC motor configured to drive a rotatable drive shaft extending toward the trailing end of the motor housing, the AC motor having an AC input connection with a defined AC voltage and phase input requirement;

a propeller attached to the rotatable drive shaft;

an AC power system electrically coupled to the AC motor, wherein the AC power system comprises:

a generator configured to generate a defined AC voltage and phase output at an AC output connection;

a variable frequency drive (VFD) having a VFD AC input connection and a VFD AC output connection, the VFD AC input connection electrically coupled to the AC output connection of the generator, the VFD AC output connection operably electrically coupled with the AC input connection of the AC motor, the VFD AC input connection having a defined AC voltage and phase input requirement corresponding to the defined AC voltage and phase output at the AC output connection of the generator, the VFD AC output connection providing a defined AC voltage and phase output corresponding to the defined AC voltage and phase input requirement of the AC input connection of the AC motor.

2. The AC propulsion system of claim 1, wherein the generator is an inverter generator.

3. The AC propulsion system of claim 1, wherein the defined AC voltage and phase input requirement of the AC input connection of the AC motor is nominal 240 volts, three phase.

4. The AC propulsion system of claim 3, wherein the AC motor produces 1 to 5 horsepower (hp).

5. The AC propulsion system of claim 3, wherein the AC motor is 2 hp or less.

6. The AC propulsion system of claim 5, wherein the defined AC voltage and phase output of the AC output connection of the generator is nominal 120 volts, single phase.

7. The AC propulsion system of claim 6, wherein the defined AC voltage and phase input at the VFD AC input connection of the VFD is nominal 120 volts, single phase.

8. The AC propulsion system of claim 7, wherein the defined AC voltage and phase output at the VFD AC output connection is nominal 240 volts, three phase.

9. The AC propulsion system of claim 3, wherein the AC motor is at least 2 hp.

10. The AC propulsion system of claim 9, wherein the defined AC voltage and phase output of the AC output connection of the inverter generator is nominal 240 volts, single phase.

11. The AC propulsion system of claim 10, wherein the defined AC voltage and phase input at the VFD AC input connection of the VFD is nominal 240 volts, single phase.

12. The AC propulsion system of claim 11, wherein the defined AC voltage and phase output at the VFD AC output connection is nominal 240 volts, three phase.

13. The AC propulsion system of claim 9, wherein the inverter generator comprises two inverter generators electrically coupled in parallel such that a combined AC output of the two inverter generators is nominal 120 volts, single phase at 30 to 50 amps, the AC Power system and further including a transformer electrically coupled to the combined AC output, the transformer configured to convert the nominal 120 volts, single phase to a nominal 240 volt, single phase at a transformer output connection, the transformer output connection electrically coupled to the VFD AC input connection of the VFD.

14. The AC propulsion system of claim 13, wherein the defined AC voltage and phase input at the VFD AC input connection of the VFD is nominal 240 volts, single phase.

15. The AC propulsion system of claim 14, wherein the defined AC voltage and phase output at the VFD AC output connection is nominal 240 volts, three phase.

16. The AC propulsion system of claim 15, further comprising:

a second trolling motor operably mountable to the boat, the second trolling motor including:

an elongated shaft;

a head secured at an upper end of the elongated shaft;

a motor housing secured at a lower end of the elongated shaft, the motor housing having a leading end and a trailing end;

an AC motor disposed within the motor housing, the AC motor configured to drive a rotatable drive shaft extending toward the trailing end of the motor housing, the AC motor having an AC input connection with a defined AC voltage and phase input requirement;

a propeller rotationally attached to the rotatable drive shaft;

the VFD having a second VFD AC output connection, the second VFD AC output connection operably electrically coupled with the AC input connection of the AC motor of the second trolling motor, the VFD AC output connection providing a defined AC voltage and phase output corresponding to the defined AC voltage and phase input requirement of the AC input connection of the AC motor of the second trolling motor.

17. The AC propulsion system of claim 1, wherein the propeller has a diameter of about six inches.

18. The AC propulsion system of claim 1, wherein the trolling motor is a tiller-handle trolling motor.

19. The AC propulsion system of claim 1, wherein the trolling motor is a foot-control trolling motor.

20. The AC propulsion system of claim 1, wherein the trolling motor is a wireless remote controlled trolling motor.

* * * * *